United States Patent [19]

Bennett

[11] 4,087,337

[45] May 2, 1978

[54] REJUVENATION OF THE EFFICIENCY OF SEA WATER ELECTROLYSIS CELLS BY PERIODIC REMOVAL OF ANODIC DEPOSITS

[75] Inventor: John E. Bennett, Painesville, Ohio

[73] Assignee: Diamond Shamrock Corporation, Cleveland, Ohio

[21] Appl. No.: 800,402

[22] Filed: May 25, 1977

[51] Int. Cl.[2] ..... C25B 1/24; C25B 15/02

[52] U.S. Cl. ..... 204/95; 204/228

[58] Field of Search ..... 204/228, 105 M, 95

[56] References Cited

U.S. PATENT DOCUMENTS

| | | | |
|---|---|---|---|
| 998,379 | 7/1911 | Namekawa et al. | 204/228 |
| 1,397,239 | 11/1921 | Slater | 204/228 |
| 3,915,817 | 10/1975 | Bennett | 204/269 |

*Primary Examiner*—T. M. Tufariello

*Attorney, Agent, or Firm*—John P. Hazzard

[57] ABSTRACT

Electrolysis of impure saline solutions containing dissolved manganese causes deposits to form on the anodes of such electrolysis cell which rapidly reduces the efficiency of the cell. The efficiency of the cell is rejuvenated periodically by changing the polarity of the anode for from one to ten minutes at an amperage of from about 2 to 50 milliamps per square inch.

5 Claims, 2 Drawing Figures

REJUVENATION OF THE EFFICIENCY OF SEA WATER ELECTROLYSIS CELLS BY PERIODIC REMOVAL OF ANODIC DEPOSITS

BACKGROUND OF THE INVENTION

It is common practice to add chemicals to sewage in order to disinfect same prior to discharge thereof into the surrounding watershed. Recently, considerable attention has been directed to the on-site generation of such disinfecting materials, especially sodium hypochlorite, in electrolysis cells. Such on-site production is desirable owing to the problems and expense involved in shipping and storing dilute hypochlorite solutions and the danger in handling the more concentrated chlorine gas in urban areas. Such processes are particularly attractive in coastal locations where the salt values of sea water provide an economical source of the hypochlorite precursor, sodium chloride. Inland, electrolytes may be prepared from solid sodium chloride, whether pure or impure.

The electrolysis of sea, brackish, or impure salt water leads to a pronounced problem, however, in the nature of the formation of heavy deposits on the electrode surfaces. It has been recognized, that calcium and magnesium impurities in the impure saline solutions can cause hardness deposits to build-up on the cathode which leads to pronounced increases in operating cell voltages and ultimately these build-up to such a thickness as to impede or prevent electrolyte flow. It has now been found that manganese dissolved in the impure brine solution causes an anodic deposit to form which likewise increases the operating cell voltage and lowers operating current efficiency. Normally, manganese is not present in sea water at the concentrations at which it causes such electrolysis problems. However, water from harbors in industrial areas often contain much higher concentrations of manganese because of pollution by the steel and other industries or by ground water which is high in manganese content. Typically, ocean water contains from 0.001 to 0.01 parts per million manganese. The manganese existing in ocean water is mainly in the form of $Mn^{++}$ or $MnSo_4$. It has been found that the threshold concentration for adverse effects due to dissolved manganese in the electrolyte in cell performance is in the range of 0.01 to 0.02 parts per million. Thus, it is apparent that normal concentration of manganese and sea water are not particularly troublesome. However, as mentioned before, waters from industrialized harbor areas often contain higher concentrations of manganese. Typically, Jamaica Bay, New York contain 0.05–0.2 ppm manganese whereas Osaka City and Tokyo Bay in Japan contain 1–4 ppm and 0.05–0.1 ppm manganese respectively.

Dissolved iron which is normally in the form of $Fe(OH)_3$ also causes deposits to form on the anode. However, these deposits are generally not deleterious to cell operation although they do discolor and interfere slightly with visual observation.

Chemically speaking, it is known to remove iron and manganese from water supplies by oxidizing these cations with air, chlorine, potassium permanganate, chlorite ion, ozone, and the like.

Various other techniques have been proposed for removing the unwanted deposits from the electrode surfaces and these include mechanical removal of the deposits, acid washing of the cell to dissolve the deposits as well as the use of sand filters or sodium alumina silicate to remove iron and manganese prior to entry of the saline solution into the electrolytic cell. However, none of the proposed solutions has been satisfactory. Mechanical cleaning is expensive and time consuming and acid cleaning can cause corrosion problems. Moreover, all the proposals require stopping the operation of the cell which means it is out of service. The use of sand filter is expensive and difficult particularly where the water is very dirty.

BRIEF SUMMARY OF THE INVENTION

The electrolysis of saline solution produces chlorine gas and caustic. These electrolysis products then react or can be caused to react to form a sodium hypochlorite solution. The present invention is applicable to cells in which impure saline solution is electrolyzed, and more particularly to impure saline solutions which contain more than about 10 parts per billion manganese. The threshold concentration for magnesium for adverse effects on cell performance has been found to be in the range of 0.01–0.02 ppm manganese. At even these low levels, manganese quickly deteriorates the efficiency of the electrolytic cell by the build-up of a very slight manganese deposit on the anode. The instant invention therefore contemplates the removal of this manganese deposit on the anode by the periodic reversal of current through the electrolytic cell. Normally, such sea water cells or cells for the electrolysis of impure saline solutions are operated at a current density in a range of about 0.2 to 1.0 amps per square inch. Current reversal to remove the manganese deposits from the anode is made at much lower current density so as not to damage the dimensionally stable anode. The current used to remove the anodic manganese deposits as contemplated by the present invention is in the range of from about 2 to 50 milliamperes per square inch and preferably in the range 2 to 20 milliamps per square inch. The time required to remove the manganese deposit from the anode of course can vary depending on the thickness of manganese deposit on said anode. Normally, however, since there is extremely small amounts of manganese in the saline solution being electrolyzed, the manganese deposit is exceedingly small even though it has a drastic effect on the current efficiency of the cell. Thus, the manganese deposit is rapidly removed from the anode even at minimal current densities. Normal operation of a cell in accordance with the instant invention would require such current reversal in the 2 to 50 milliamp per square inch range only once every 24 hours for time periods in the range of 1 to 10 minutes.

Another aspect of the instant invention is that since such low level current reversal in an economic time period successfully removes the detrimental manganese deposits from the anode, the bus feeding current to the cells for normal operation need not be disconnected in order to effect the low level current reversal through the cell or cells. Specifically, the operating current to the cell need only be turned off once every 24 hours and a reverse current through the cell in the 2 to 50 milliamps per square inch range be applied in the reversed direction for a period of from one to ten minutes in each 24 hour period of cell operation on an impure saline solution feed. The low level reverse current is low enough not to destroy the activity of the dimensionally stable anodes used in the process.

DETAILED DESCRIPTION OF THE INVENTION

Figure 1:
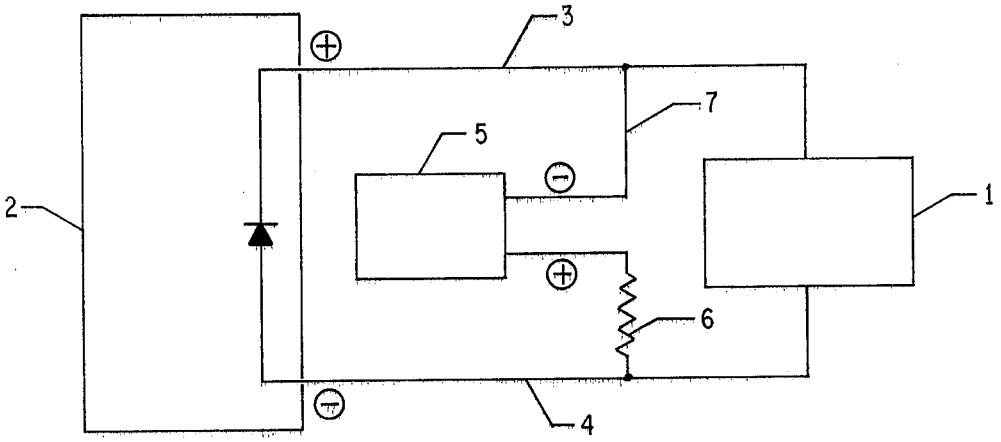
FIG. 1 is a schematic outline of a single electrolytic cell equipped with a secondary rectifier means in accordance with the instant invention whereby a low level reverse current through the cell removes interfering anodic deposits and maintains high current efficiency.

On site generation of sodium hypochlorite is becoming ever more popular since the electrolysis of saline solutions to produce sodium hypochlorite has become much more trouble-free and more economic. On site hypochlorite generation also avoids costly transportation of dilute hypochlorite solutions and also avoids the dangers inherent in chlorine gas.

Due to the development of dimensionally stable electrodes, continuous operation of a hypochlorite generation cell with minimal attention has become more a reality. However, impurities normally found in saline solutions have precipitated in the electrolytic cell and form interfering deposits on the electrodes. Generally, such deposits would occur on the cathode or cathodes of the electrolytic cell and would be caused by impurities such as calcium and magnesium. Such build-ups would gradually affect a loss in current efficiency and ultimately would grow to the extent that they would block electrolyte flow through the cell. Such build-ups on the cathode have been handled in various ways. For example, cathodes have been made extremely smooth so that they resist deposits adhering firmly thereto. Also electrolyte flow has been speeded up past the cathodes so as to help in sweeping the cathode surface of deposits. Cathode deposits have also been acid washed to remove same and other successful control measures which have been used in the past. For example, reversal of the direction of current flow at high current has been used in the past in an effort to remove calcium and magnesium deposits, but this procedure creates serious disadvantages. The switching of high current involves operating difficulties since heavy bus must be disconnected and reconnected frequently. Automatic high current switches are complex and expensive. This practice also severely limits the materials of electrode construction since few electrodes can function as both an anode and a cathode. Dimensionally stable anodes as well as titanium, iron or nickel cathodes cannot sustain high current density in the reverse direction.

It has been discovered that there is also a problem with anodic deposits caused by impurities in the fed saline solution. Such anodic deposits are caused by the precipitation of dissolved iron and manganese from the saline solution onto the anode in the electrolytic cell. The precipitation of the dissolved iron discolors the cell but does not appear to be damaging to current efficiency. On the other hand, manganese present in excess of 10 ppb in the feed saline solution will precipitate and form an adherent deposit on the anode of the electrolytic cell which will rapidly decrease the current efficiency of the cell.

Normally, sea water or artificially-produced saline solution would not have sufficient manganese content to require the use of the instant invention. Sea water usually contains less than 10 ppb manganese and typically the manganese content is in the range of 1–3 ppb manganese. However, in contaminated waters which contain more than about 10 ppb manganese the instant invention is most useful in effecting a continuous electrolysis of the impure saline solution to form hypochlorite. Typically, such impure saline solutions are found in harbor areas near iron and steel production facilities or in areas where ground run-off water contains high manganese content.

Essentially, the present invention provides a means to convert impure aqueous saline solution, especially sea water into a solution having microbicidal properties. This is accomplished by the relatively low current density electrolysis of saline solution into a hypochlorite solution. The current density normally employed in such electrolysis is in the range of from about 0.2 to about 1.0 amps per square inch. When the saline solution being electrolyzed contains more than about 10 parts per billion manganese, a manganese precipitate develops on the anode or anodes in the electrolytic cells which rapidly decreases the current efficiency of the process. When practicing the present invention, the electrolysis is allowed to continue until the current efficiency of the system drops to a preselected level. The preselected level can be a specific percent of current efficiency or when dealing with relatively consistent feed materials, the practice of the present invention can be done simply on a lapsed time basis after experience is gained regarding the rate of manganese build-up. Normally, the removal of the manganese containing deposit on the anode would be affected on a lapsed timed basis since most feed materials would be relatively consistent. Our experience has shown that removal of the manganese containing build-up on the anode need be accomplished only once in a 24 hour period to affect a highly efficient operation.

The specific means employed for removing the manganese containing deposit from the anode or anodes in the instant invention is to reverse the current through the cell or cells so that the anode is rendered cathodic for a period sufficient to remove said manganese containing deposit. By current reversal, it is not meant to be implied that the full operating current is reversed. Quite to the contrary, full current reversal would damage the dimensionally stable anode used in such systems as well as dissolve a part of the cathode and would decrease the effectiveness of the cell from that standpoint. Current reversal in the instant invention is meant to imply a low level current in the range of 2 to 50 milliamps per square inch and preferably in the range from about 2 to 20 milliamps per square inch. Such current reversal can be applied to the system from a separate power source and such effectively removes the manganese deposit on the anode in from one to ten minutes.

Tests have shown that the $MnO_2$ which accumulates on the anode surface is easily reduced by a brief reverse in cell polarity. The reaction which causes the efficiency decline is as follows:

$$Mn^{++} + 2H_2O \rightarrow MnO_2 + 4H^+ + 2e-$$

This reaction is easily reversed by the reduction cycle technique. Reversing the cell voltage also reverses current, but the low current level, i.e., less than 50 milliamps per square inch and, most preferably, at about 8 milliamps per square inch, result in major advantages for this technique. Due to the small current involved, a small secondary rectifier can be used to supply the reverse current; and the main D.C. bus need not be switched or disconnected due to the threshold voltage in the diode bridge in the main rectifier which resists flow back through the main rectifier and causes the impressed secondary current to flow through the cells in the reverse direction. Thus, reversing polarity of the electrodes and removing the manganese dioxide build-up on the anodes thereof without having to disconnect the main power supply other than interrupting the A.C. power feed to the main rectifier.

The electrolytic cell used in the present invention to electrolyze the saline solution contains at least one anode and one cathode. Normally, however, there would be an alternating array of preferably vertically disposed anodes and cathodes spaced about 0.20 to 0.5 centimeters apart. The saline solution containing dissolved manganese impurities in excess of about 10 parts per billion by weight is passed between the electrodes and electrolyzed by a current in the range of from about 1.5 to 25 amperes per square decimeter to produce chlorine and sodium hydroxide. A rapid chemical reaction then occurs to produce sodium hypochlorite at a concentration which depends on a variety of factors such as current density, electrolyte flow rate, temperature, and salinity.

By the term "impure saline solution", it is intended to refer to sea water, brackish water, or an aqueous solution prepared from impure salt, all of which contain manganese ions in excess of about 10 parts per billion. Generally, the concentration of sodium chloride in the solutions, for economic and practical reasons, will be within the range of 10–35 grams per liter.

The anodes employed are generally flat, and dimensionally stable, i.e., not significantly subject to chemical or mechanical attrition in use. The anode composition is not critical to the present invention as any electrically conductive substrate bearing an electrocatalytically active coating on the surface thereof will generally suffice. Typical is titanium metal coated with titanium dioxide-ruthenium dioxide solid solution. While sheet or continuous anodes are satisfactory, superior results will be obtained if foraminous anodes are employed. This serves to increase inner electrode turbulence without detracting from uniformity of velocity, thereby further reducing cathodic deposits. In any event, the dimensionally stable anodes used in this invention are subject to deactivation and destruction if the polarity of the anode is reversed and the current flow is above that used in the instant inventions.

The cathodes employed are preferably flat, in the sense of lying in one level plain, and continuous (not perforated or segmented). Preferably, the leading and terminal, i.e., vertical edges are smooth and rounded rather than being angular. While is is generally stated that the smoother the surface of both anode and cathode, the better the results will be, a maximum roughness of less than $2.54 \times 10^{-4}$ centimeters is preferably employed. Such cathodes will be metallic for reasons including wear resistance, electrical conductivity, and low hydrogen over voltage. Typical are titanium, nickel and various ferrous and nickel alloys. Especially preferred is Hastalloy C, a trademark of Union Carbide Corporation for a nickel alloy. Since the surfaces are metallic, the low roughness values can generally be achieved with conventional metal working techniques such as polishing or the like. Here again if the current reversal was done at high amperages, the electrodes especially the Hastalloy C would be dissolved and relatively quickly destroyed.

All unstated conditions of operations are conventional and not critical to the invention. For example, a pH within the range of 6.0 to 10 and temperatures of 5°–50° C are typically employed in the electrolytic production of sodium hypochlorite from sodium chloride solutions.

In order that those skilled in the art may more readily understand the present invention in certain preferred embodiments, reference to the FIG. 1 is offered. This FIG. 1 represents a schematic layout of the preferred form of the present invention.

In FIG. 1 of the drawings, cell 1 is connected electrically with rectifier 2 via connecting bus 3 and 4. Rectifier 2 supplies the power required for normal operation of cell 1. A secondary rectifier 5 is operatively connected to cell 1 to effect the brief low level current reversal through the cell when rectifier 2 is deactivated. As shown in the drawing, secondary rectifier 5 is connected to connector 3 and to connector 4 through connector 7 and resistor 6, respectively. The resistor is sized so as to effectively prevent any more than minor amounts of current flow through the secondary rectifier 5 when the electrolytic cells are in normal operation. When it is desired to remove the anodic manganese deposits in cell 1 so as to improve current efficiency, main rectifier 2 is first deactivated. This is followed by the activation of the secondary rectifier 5 in order to supply the desired reverse current through the cell for the appropriate time period to remove the manganese build up on the anodes in said cell. During this time the diodes in the primary or normal rectifier 2 have sufficient resistance to effectively prevent the flow of current from the secondary rectifier 5 through rectifier 2 and force the current through the cell 1 in the reverse direction of normal operation. If no anodic manganese deposits are present in the cell, or if the reduction cycle has been activated long enough to effectively remove any anodic manganese deposits present, the resistance of cell 1 will then be higher allowing a significant portion of the current from secondary rectifier 5 to pass through primary rectifier 2. The circuit shown by FIG. 1, therefore, allows a low-level current to pass through the cell 1 in a direction opposite to that of normal operation when anodic manganese deposits are available for reduction, but effectively limits the passage of low level reverse current when manganese deposits are not present. This further prevents unnecessary reverse current from passing through the cell which may over a period of time damage the dimensionally stable anode used in such systems. At no time is it necessary or desirable to disconnect the main conducting bus 3 and 4 from the circuit.

Figure 2:
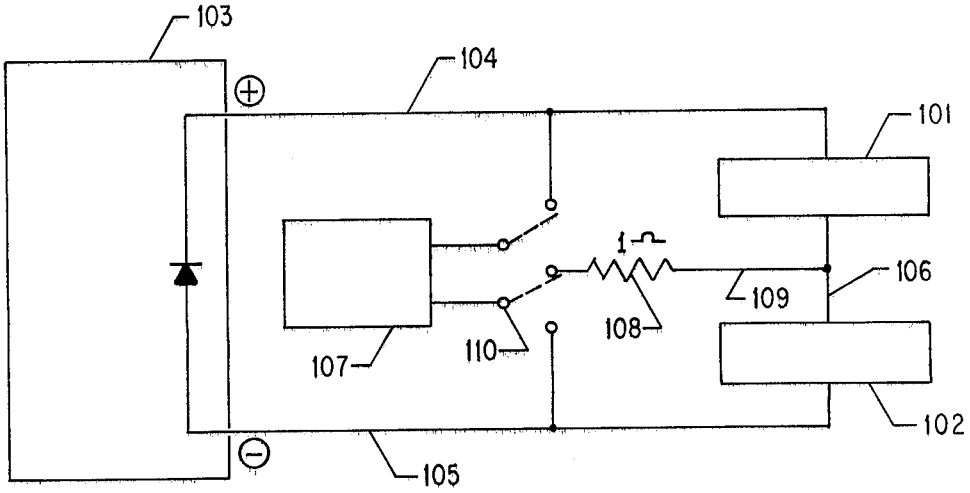
FIG. 2 is a schematic outline of a set of cells equipped with a secondary rectifier means in accordance with the instant invention whereby a low level reverse current is applied through the cells without need of disconnecting the normal electrical connections to said cells.

In practice, it is common to connect two or more cells together in electrical series in order to improve rectifier efficiency. In this case, the circuit described by FIG. 2 is used. In the drawing, cells 101 and 102 are connected in series with rectifier 103 via connectors 104, 105 and 106. Rectifier 103 supplies the power required for normal operation of cells 101 and 102. A secondary rectifier 107 is operatively connected to cells 101 and 102 to effect the brief low level current reversal through the cells when rectifier 103 is deactivated. As shown in the drawing, secondary rectifier 107 is connected through switch 110 to either connectors 104 and 106 via resistor 108 and connector 109 so as to reverse current on cell 101, or the connectors 105 and 106 via resistor 108 and connector 109 so as to reverse current on cell 102. The resistor 108 is sized such as to effectively prevent any more than minor amounts of current flow through the secondary rectifier when the electrolytic cells are in normal operation. When it is desired to remove the anodic manganese deposits in cells 101 and 102 so as to improve current efficiency, main rectifier 103 is first deactivated. This is followed by activation of secondary rectifier 107 with switch 110 in position to reverse current on cell 101. During this time the resistance of the diodes in the primary or normal rectifier 103 together with the resistance of cell 102 is sufficient to effectively prevent the flow of current from the secondary rectifier 107 through rectifier 103 and cell 102 and to force the current through the cell 101 in the reverse direction of normal operation. If no anodic manganese deposits are present in the cell, or if the reduction cycle has been activated long enough to effectively remove any anodic manganese deposits present, the resistance of cell 101 will then be higher allowing a significant portion of the current from secondary rectifier 107 to pass through primary rectifier 103 and cell 102. The circuit shown by FIG. 2, therefore, allows a low-level current to pass through the cell 101 in a direction opposite to that of normal operation when anodic manganese deposits are available for reduction, but effectively limits the passage of low level reverse current when manganese deposits are not present. This further prevents unnecessary reverse current from passing through the cell which may over a period of time damage the dimensionally stable anode used in such systems. After a period of time sufficient to effectively remove the anodic manganese deposits from cell 101, switch 110 is thrown into position to reverse current on cell 102. In this case, flow of current through the primary rectifier 103 is again effectively prevented as described before if there are anodic manganese deposits present in cell 102. After a period of time sufficient to remove the manganese deposits in cell 102, the secondary rectifier 107 is deactivated and the primary rectifier 103 is activated to commence normal operation. The cells 101 and 102 may both be replaced with two or more cells in electrical series and the circuit described by FIG. 2 will still be effective. In any case it is not necessary or desirable to disconnect the main conductor bus 104, 105 and 106 from the circuit.

In the following examples there are described several preferred embodiments to illustrate the present invention. However, it is to be understood that the invention is not intended to be limited to the specific embodiments described therein.

EXAMPLE 1

A laboratory cell provided with two Hastalloy C-276 cathodes and two anodes provided with ruthenium dioxide-titanium dioxide coating with an active area of 11.25 $in^2$ was tested for efficiency by batch electrolysis of a solution containing 28 g/1 of sodium chloride and 0.004 g/1 of $Na_2Cr_2O_7$. The electrolysis was conducted for 30 minutes during which 8.08 gm/1 of chlorine were generated at a current efficiency of 63.6%.

The cell was then operated using the method shown by FIG. 1 with an aqueous solution of 28 g/1 of sodium chloride and 0.2 ppm of $Mn^{+2}$ at 1.0 ASI. The high concentration of $Mn^{+2}$ in this test has the effect of accelerating the loss of efficiency caused by the deposition of manganese on the anode surface. Normal electrolysis was effected for 30 minutes and the current was then reversed at 8 milliamps per square inch for 5 minutes. Following current reversal the cell was returned to normal operation and this sequence was repeated for 338 cycles. At the end of the last sequence, the cell was again tested for efficiency by the 30 minute batch electrolysis test described above. During the test 8.17 g/1 of chlorine were generated at a current efficiency of 64.3% indicating no loss of efficiency due to anodic manganese deposits.

The cell was then returned to electrolysis in the 28 g/1 sodium chloride, 0.2 ppm $Mn^{+2}$ solution. Electrolysis was again conducted at 1.0 ASI, using current reversal at 8 milliamps per square inch at 30 minute intervals as before. A batch efficiency test was again conducted after 2500 cycles. During this 30 minute test 9.23 g/1 of chlorine were generated at a current efficiency of 73.4% again indicating no loss of efficiency due to anodic manganese deposits.

During this accelerated test the Hastalloy C-276 cathodes lost only 1% of their original weight. This is considered satisfactory since under normal conditions of electrolysis 2500 cycles represents several years of lifetime.

EXAMPLE 2

Two cells were provided, each having two Hastalloy C-276 cathodes and three anodes provided with ruthenium dioxide-titanium dioxide coating with an active area of 1250 $in^2$. The two cells were first operated in series for several days without using any current reversal at 1250 amps using sea water having a salinity 70% that of normal ocean water and containing 50–200 ppb manganese. During 10 days of continuous operation, cell current efficiency dropped from 78% to 44%. Following this operation, the cells were acid washed to remove all anodic manganese deposits. Thereafter, current was reversed automatically on each cell as described by FIG. 2 for 5 minutes each day at a current density of 8 milliamps per square inch. While operating in this manner, the current efficiency of the cells experienced no significant decrease for a period of 40 days with current efficiency always remaining in the 70+% range.

EXAMPLE 3

The same system illustrated by FIG. 2 and used in EXAMPLE 2 was operated at 1250 amps using sea water having a salinity 90–100% that of normal ocean water. In this case the manganese present was below 20 ppb, the limit of simple analytical analysis, but was sufficient to cause a discoloration in the cell, and to lower the cell current efficiency from 86% to 75% in 3 months. Following this period of operation the cells were acid-washed to remove all anodic manganese deposit. An analysis of the acid wash confirmed the presence of manganese at that time. The reduction cycle by means of current reversal was then started and current was reversed automatically on each cell for 5 minutes each day at a current density of 8 milliamps per square inch. While operating in this manner, the current efficiency of the cells experienced no significant decrease for a period of 3 months.

Various modifications of the cathodes and cells and process of the invention may be made without departing from the spirit or scope thereof, as for example bipolar electrodes could be used in place of the monopolar ones described, and it is to be understood that the invention is intended to be limited only as defined in the appended claims.

What is claimed is:

1. A method of removing mineral deposits from electrodes, at least one of said electrodes is a dimensionally stable anode, in an electrolysis cell comprising operating the electrolysis cell at a current density of at least 0.2 amps per square inch until there is a reduction in cell efficiency, briefly reversing the cell polarity at reduced current densities of less than about 50 milliamps per square inch for a period of time sufficient to remove interfering mineral deposits and thereafter operating the electrolysis cell normally by reversing polarity and operating at current densities of at least about 0.2 amps per square inch.

2. The method of claim 1 wherein the lower current density is about 2 to 20 milliamps per square inch for a period of 1 to 10 minutes.

3. A method of removing manganese from at least one dimensionally stable anode of an electrolysis cell comprising operating the electrolysis cell normally at a current density of at least about 0.2 amps per square inch until there is an undesirable reduction in cell efficiency due to the build up of anodic manganese deposits, briefly reversing the cell polarity at lower current densities of less than about 50 milliamps per square inch for a period of time sufficient to remove said anodic manganese deposits and then returning the cell to normal operating conditions.

4. The method of claim 3 wherein the lower current density is from about 2 to 20 milliamps per square inch for a period of from about 1 to 10 minutes for each 24 hours of normal cell operation.

5. A method of removing interfering mineral deposits from electrodes including anodic manganese deposits in a sea water electrolysis cell wherein at least one of said electrodes is a dimensionally stable anode comprising operating said cell normally by supplying an operating current from a primary rectifier to said cell such that the current density is at least about 0.2 amps per square inch until there is a reduction in cell efficiency due to mineral deposits forming on the electrodes, thereafter discontinuing the power supply from the primary rectifier and activating a secondary rectifier so as to supply a reduced current to said cell of opposite polarity, said current supplied from said secondary rectifier resulting in a current density of less than about 50 milliamps per square inch for a time period sufficient to remove interfering mineral deposits including anodic manganese deposits from the electrodes, said time period normally requiring from about one to ten minutes for each 24 hours of normal cell operation, thereafter discontinuing the power supply from the secondary rectifier and resupplying the power to the cell from the primary rectifier as before while preventing most current flow through the secondary rectifier by means of a resistor in line with the secondary rectifier during normal operation of the cell.

* * * * *